US008257008B2

(12) United States Patent
Ellingson

(10) Patent No.: US 8,257,008 B2
(45) Date of Patent: Sep. 4, 2012

(54) WAREHOUSE LOADER

(75) Inventor: Gary L. Ellingson, Orlando, FL (US)

(73) Assignee: Walgreen Co., Deerfield, IL (US)

( * ) Notice: Subject to any disclaimer, the term of this patent is extended or adjusted under 35 U.S.C. 154(b) by 818 days.

(21) Appl. No.: 11/725,281

(22) Filed: Mar. 19, 2007

(65) Prior Publication Data

US 2008/0232942 A1 Sep. 25, 2008

(51) Int. Cl.
*B66F 9/18* (2006.01)

(52) U.S. Cl. ..... 414/608; 414/663; 182/14

(58) Field of Classification Search ..... 414/663, 414/785, 266, 267, 276, 281, 607, 608, 631, 414/659, 662; 180/68.5; 188/188; 182/14, 182/15, 17, 36, 37, 113; 187/222, 224, 231, 187/233, 253, 313, 314, 332
See application file for complete search history.

(56) References Cited

U.S. PATENT DOCUMENTS 3,016,973 A * 1/1962 Williamson ..... 182/14
3,521,775 A * 7/1970 Vermette ..... 414/495
3,643,825 A * 2/1972 Zane, Jr. ..... 414/607
3,762,589 A * 10/1973 Shaffer ..... 414/664
3,817,346 A * 6/1974 Wehmeyer ..... 182/14
3,825,095 A * 7/1974 Clark ..... 182/17
3,836,031 A * 9/1974 Weisker et al. ..... 414/668
3,889,833 A * 6/1975 Thomas ..... 414/607
3,934,681 A * 1/1976 Herrell ..... 187/253
3,993,207 A * 11/1976 Jones ..... 414/495
4,062,457 A 12/1977 McLean
4,222,140 A * 9/1980 Olewinski et al. ..... 14/71.3
4,304,518 A * 12/1981 Carder et al. ..... 414/495
4,405,279 A 9/1983 Davy et al.
4,634,336 A 1/1987 Pearce
4,770,427 A 9/1988 Howell et al.
4,944,546 A * 7/1990 Keller ..... 296/61
4,993,908 A 2/1991 Park
5,096,018 A * 3/1992 Dickinson, Jr. ..... 182/69.6
5,096,362 A * 3/1992 Best ..... 414/537
5,156,432 A * 10/1992 McCleary ..... 296/61
5,211,345 A 5/1993 Siebenga
5,397,208 A 3/1995 Siebenga
5,476,360 A 12/1995 Liljevik
5,499,694 A * 3/1996 Dorn ..... 187/200
5,639,198 A 6/1997 Pearce
5,674,043 A * 10/1997 Dorn ..... 414/541
5,988,725 A * 11/1999 Cole ..... 296/61
6,182,798 B1 * 2/2001 Brady et al. ..... 187/282
6,648,581 B2 * 11/2003 Gibson ..... 414/663
(Continued)

*Primary Examiner* — Saul Rodriguez
*Assistant Examiner* — Glenn Myers
(74) *Attorney, Agent, or Firm* — Francis C. Kowalik; Marshall, Gerstein & Borun LLP; Randall G. Rueth

(57) ABSTRACT

The disclosed warehouse loader has two platform sections. One section is hinged to a deck where the operator stands when moving the loader. The other section is hinged to the first section and can be aligned with the first section to create a platform that extends outwardly from the deck and can be accessed by the operator directly from the deck. The second section is narrower than and folds against the first section. A spring-loaded latch holds the first section in an upright position, with the second section folded against it. A manually-operable positioning hook engages receptacles in the platform sections, making it easier to fold the sections. To retrieve a spilled article, the loader is first positioned at an open location adjacent the spilled article. The platform is extended into the open location. The operator can then stand on the platform while retrieving the article.

5 Claims, 15 Drawing Sheets

U.S. PATENT DOCUMENTS

| | | | | |
|---|---|---|---|---|
| 6,764,123 | B1 * | 7/2004 | Bilyard | 296/61 |
| 2002/0021956 | A1 * | 2/2002 | Winkler | 414/349 |
| 2004/0156702 | A1 | 8/2004 | Sulameri | |
| 2005/0105990 | A1 | 5/2005 | Maclay | |
| 2006/0104760 | A1 | 5/2006 | Cecil et al. | |

* cited by examiner

WAREHOUSE LOADER

CROSS-REFERENCE TO RELATED APPLICATIONS

Not applicable.

BACKGROUND OF THE INVENTION

The present invention relates generally to the operation of warehouses, and more particularly to the problem of retrieving articles that may spill from warehouse locations.

Conventionally, workers climb into the racks with or without the assistance of ladders. Retrieval of spilled articles often involves strenuous reaching or bending, which can be dangerous.

BRIEF SUMMARY

The applicants have developed a modification for conventional warehouse loaders that may provide a safer way to retrieve spilled articles. Unlike other known loaders, the new loader has two extendable platform sections. One of those sections is hinged to an operating deck that is adjacent to and directly accessible from a driving deck where the operator can stand when moving the loader. The other section is hinged to a distal end of the first platform section and can be aligned with the first section to create a platform that extends outwardly from the deck and can be accessed by the operator directly from the deck.

For use in this particular context, it may be preferred that the platform sections are each between 12 and 36 inches wide, can support 300 pounds of weight, and weigh less than 40 pounds. It may also be preferred that the platform sections are extendable outwardly from a side of the loader.

In some instances, options can be implemented to facilitate use and storage of the platform sections. For example, the second platform section can be made 1-3 inches narrower than the first platform section, and can be arranged so that it folds against one side of the first extendable platform section. A spring-loaded latch can be arranged to selectively hold the first section in an upright position, with the second section folded against one side of the first section. A manually-operable positioning hook can also be provided to allow the user to selectively engage receptacles in the platform sections, making it easier to fold or unfold the sections.

To retrieve a spilled article, the warehouse loader is first positioned at an open location adjacent the spilled article. This may be, for example, an open pallet location. The foldable platform is then extended from the first section into the open location. It may be supported by pallet supports in that location. The operator can then stand on the foldable platform while retrieving the spilled article.

BRIEF DESCRIPTION OF THE DRAWINGS

The invention may be better understood by referring to the accompanying drawings, in which.

DETAILED DESCRIPTION

Figure 1:
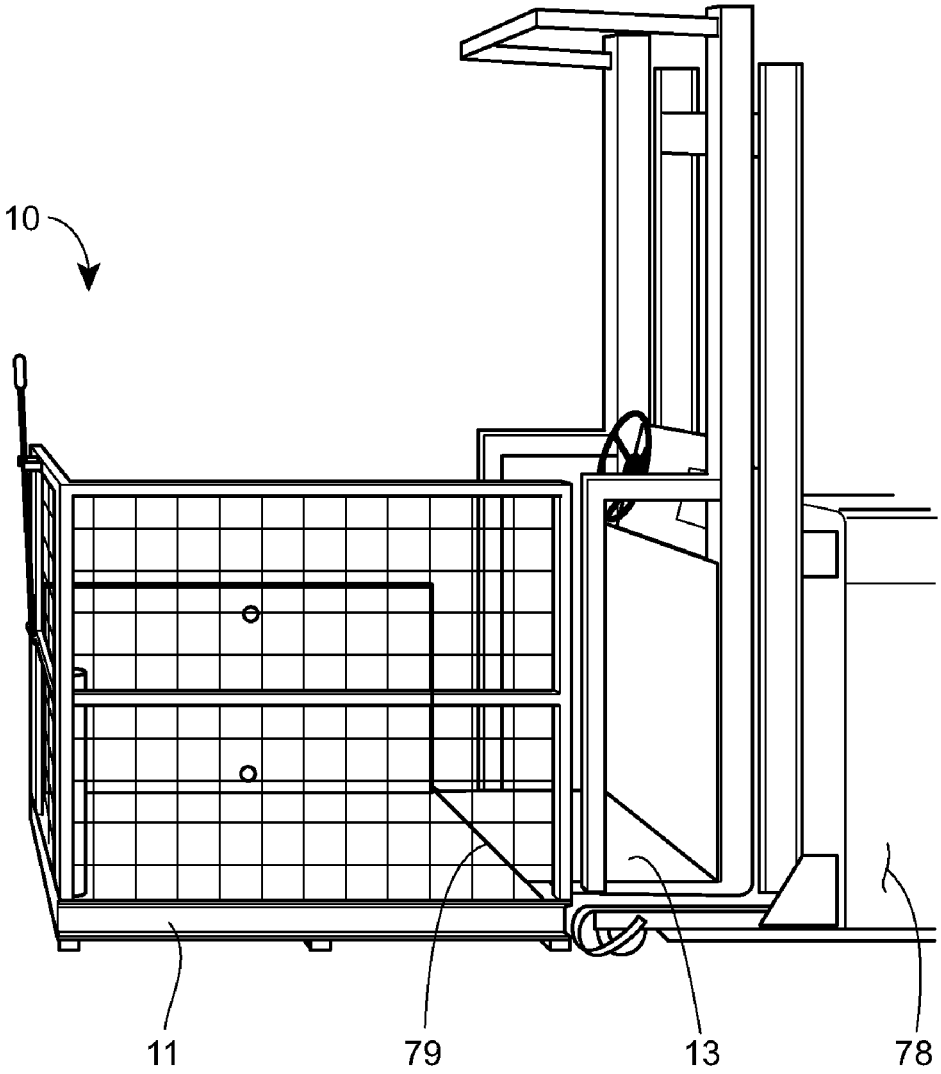
FIG. 1 is a perspective view of portions of one kind of warehouse loader that embodies the invention.
Figure 2:
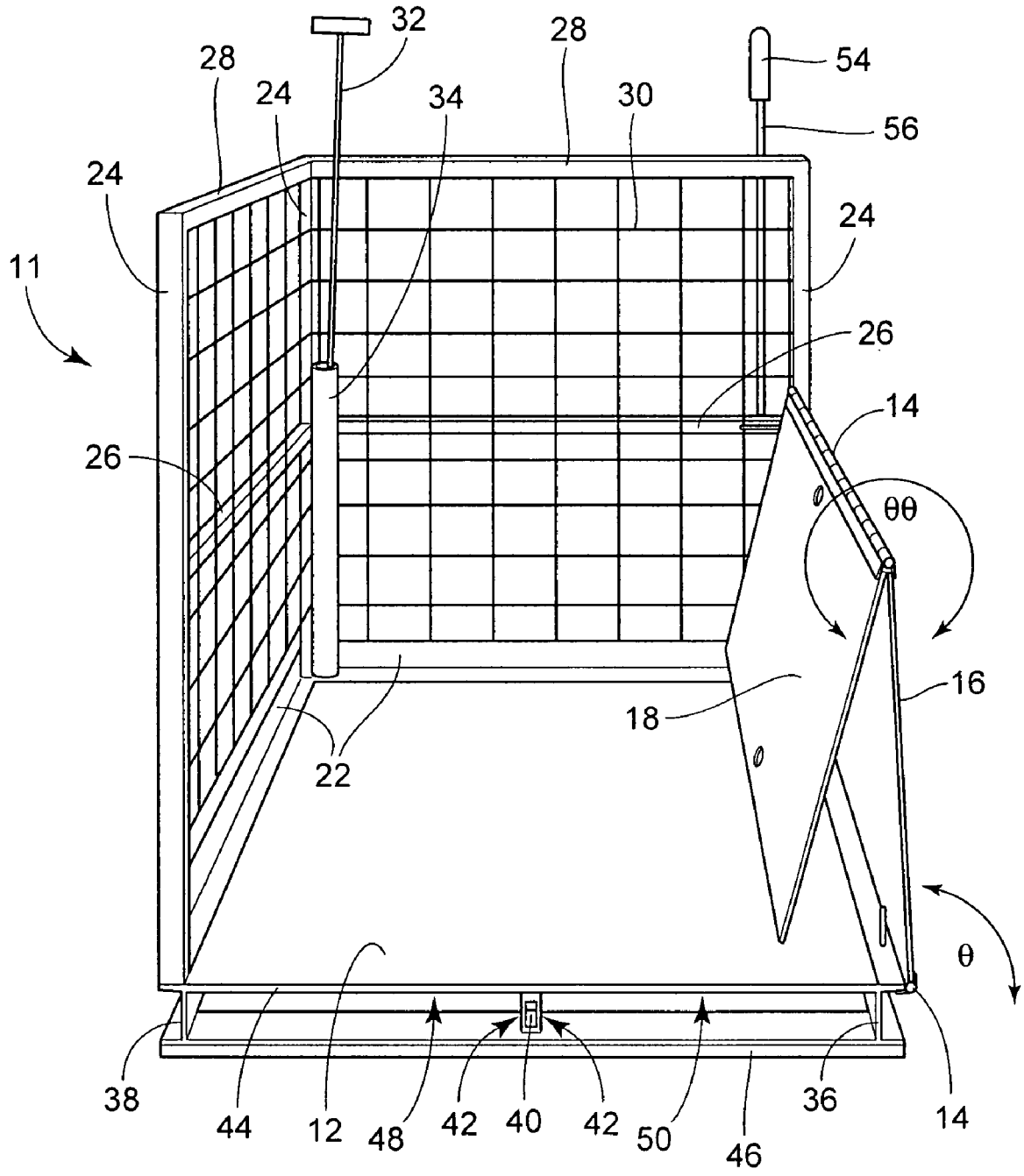
FIG. 2 is a perspective view of an operating assembly that is shown on the loader of FIG. 1.

FIG. 1 illustrates a warehouse loader, generally denoted by reference number 10. This warehouse loader 10 includes an assembly 11 carried on the forks of an order selector typically used within a warehouse environment. As shown in FIG. 2, the assembly 11 of the illustrated warehouse loader 10 includes an operating deck 12 that is made of material strong enough to support a weight of 300 pounds. The operator can stand on the operating deck when moving the loader up and down. This deck 12 may be constructed of such materials as wood or diamond plate steel and may have a non-slip coating applied as a safety feature. The operating deck 12 may be sized to various standard pallet dimensions, such as to 40 inches wide by 48 inches deep, for example. The operating deck 12 is adjacent to and can be accessed directly from a driving deck 13 on an order selector 78 (FIG. 1).

As shown in FIG. 2, the operating deck 12 may have a hinge 14 attached along its entire depth from front to back. This hinge 14 may be constructed as one continuous segment, such as a piano hinge, and may include one pin running the length of its joint. Other types of hinges can also be used. The illustrated hinge 14 connects the operating deck 12 to a first extendable platform section 16, which may typically range from 12 to 36 inches in width. This hinge 14 may have a range of rotation "Θ" of at least about 0 to 90 degrees, e.g., allowing the first platform section 16 to move from a horizontal position (0 degrees) to a near vertical position (90 degrees). The first platform section 16 can be designed of material such as diamond plate, to support weight up to 300 pounds. Preferably, it weighs less than 40 pounds.

A comparable hinge 14 on a distal end of the first platform section 16 connects the first platform section, along its entire depth, to a proximal edge of a second extendable platform section 18. The second platform section 18 may range from 12 to 36 inches in width as well. The illustrated second platform 18 section is 1-3 inches narrower than the first extendable platform section to facilitate folding. Like the first platform section 16, the second platform section 18 is designed of material such as diamond plate, in order to support weight up to 300 pounds. Again, light weight is preferred.

Figure 3:
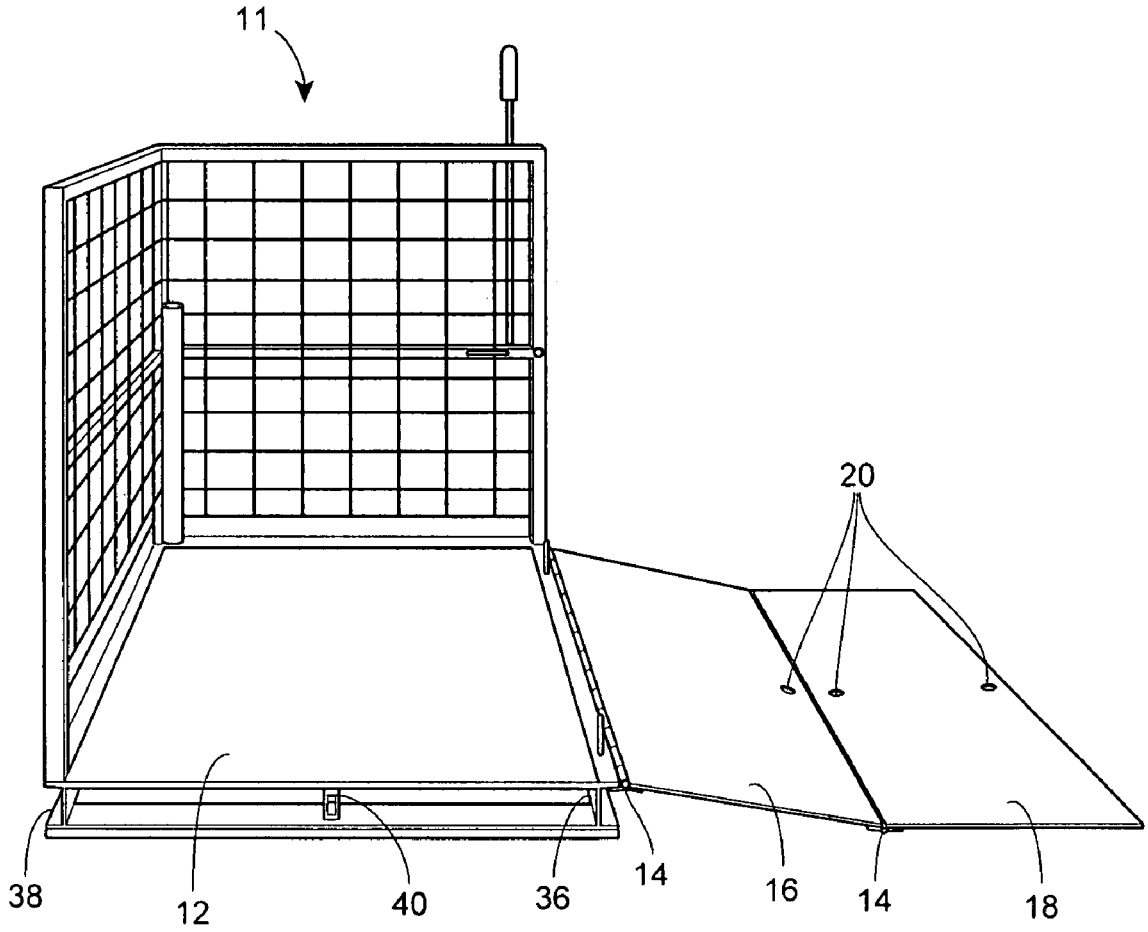
FIG. 3 is a perspective view of the assembly, with the platform extended.

The second hinge 14 that connects the two platform sections 16, 18 may have a range of rotation "ΘΘ" of 0 degrees to just less than 180 degrees. FIG. 2 shows a final folded upright resting position of the two illustrated platform sections 16, 18, with the second platform section 18 not quite folding flat against the upright first platform section 16. FIG. 3 shows the platform area that is created when both the first platform section 16 and the second platform section 18 are unfolded from their upright resting position and laid out horizontally, creating an extended platform that extends outwardly from the operating deck 12 and can be accessed by the operator directly from the operating deck and from the driving deck 13.

As shown in FIG. 3, the illustrated first platform section 16 includes a positioning aperture 20 and the second platform section 18 includes two positioning apertures 20. Each positioning aperture 20 is a location into which a positioning hook 32 (see FIGS. 5 and 6) may be placed by an operator to more easily manipulate the platform section (see FIGS. 12, 13, 15, and 16). The manipulation would typically be either in an unfolding direction from an upright resting position (see FIG. 2) to a horizontal position (see FIG. 3), or in a folding direction from a horizontal position to an upright resting position. Although the position could vary, each illustrated positioning aperture 20 is located close to the middle of the width of its respective platform section 16, 18 and near to a front-to-back edge of that platform section. The illustrated locations of the positioning apertures 20 are intended to minimize the effort an operator needs to exert to fold and unfold the platform sections 16, 18.

FIGS. 2 and 3 show other features that can be included in the warehouse loader 10. A kick plate 22 is positioned above the rear edge and also above the left side edge of the operating deck 12. This kick plate 22 may be made of diamond plate steel or other thin, strong material and can be positioned to keep the operator and/or any items that may be placed on the deck 12 from falling off. The front edge of the operating deck 12 is left open so that the operator can enter and exit the deck 12 from the driving deck 13 of the order selector 78 that carries the assembly 11. The right side of the operating deck 12 is occupied by the folded platform sections 16, 18 and would thus not need a kick plate 22.

Rising from three corners of the operating deck 12 are three uprights 24. Along with two cross members 26 and two hand rails 28, these uprights form a structure to contain the operator and the contents of the operating deck 12 during usage. This structure may be constructed of sections of the same material, such as square metal tubing, for example, and welded together for rigidity. Other materials and joining methods may be acceptable as long as the structure is constructed securely. A safety net 30 can also be attached to each upright 24, cross member 26, and hand rail 28 to aid in containing the operating deck contents.

In the back left corner of the operating deck 12, the positioning hook 32 is stored upright within a positioning hook holder 34. A typical positioning hook holder 34 may be constructed of a piece of PVC or similar tubing that may be hollow and may have a bottom end to enclose the positioning hook 32. If there is no bottom end, then the positioning hook 32 may rest against the operating deck 12 when stored. The positioning hook holder 34 is preferably affixed in an upright position to the corner upright 24, but other arrangements are possible.

The operating deck 12 rests upon and is supported by a right rail 36, a left rail 38, and a middle rail 40. A non-slip coating 42 can be applied to each vertical surface of the middle rail 40 along its entire depth, from the front to the rear of the assembly 11 of the warehouse loader 10. When used, this non-slip coating 42 may aid in providing a positive connection between the assembly 11 and the pallet locking mechanism of the order selector 78 (see FIG. 1). A top rail 44 and a bottom rail 46 can be used to tie together the ends of the right rail 36, the left rail 38, and the middle rail 40. In the illustrated device, a left slot 48 is created in the space between the left rail 38 and the middle rail 40, underneath the top rail 44, and above the bottom rail 46. This left slot 48 accommodates the left fork of the order selector 78 (FIG. 1) to support the assembly during use. Similarly, a right slot 50 is created in the space between the right rail 36 and the middle rail 40, underneath the top rail 44, and above the bottom rail 46. This right slot 50 accommodates a right fork 76 of the order selector 78 to support the assembly 11 during use.

Figure 4:
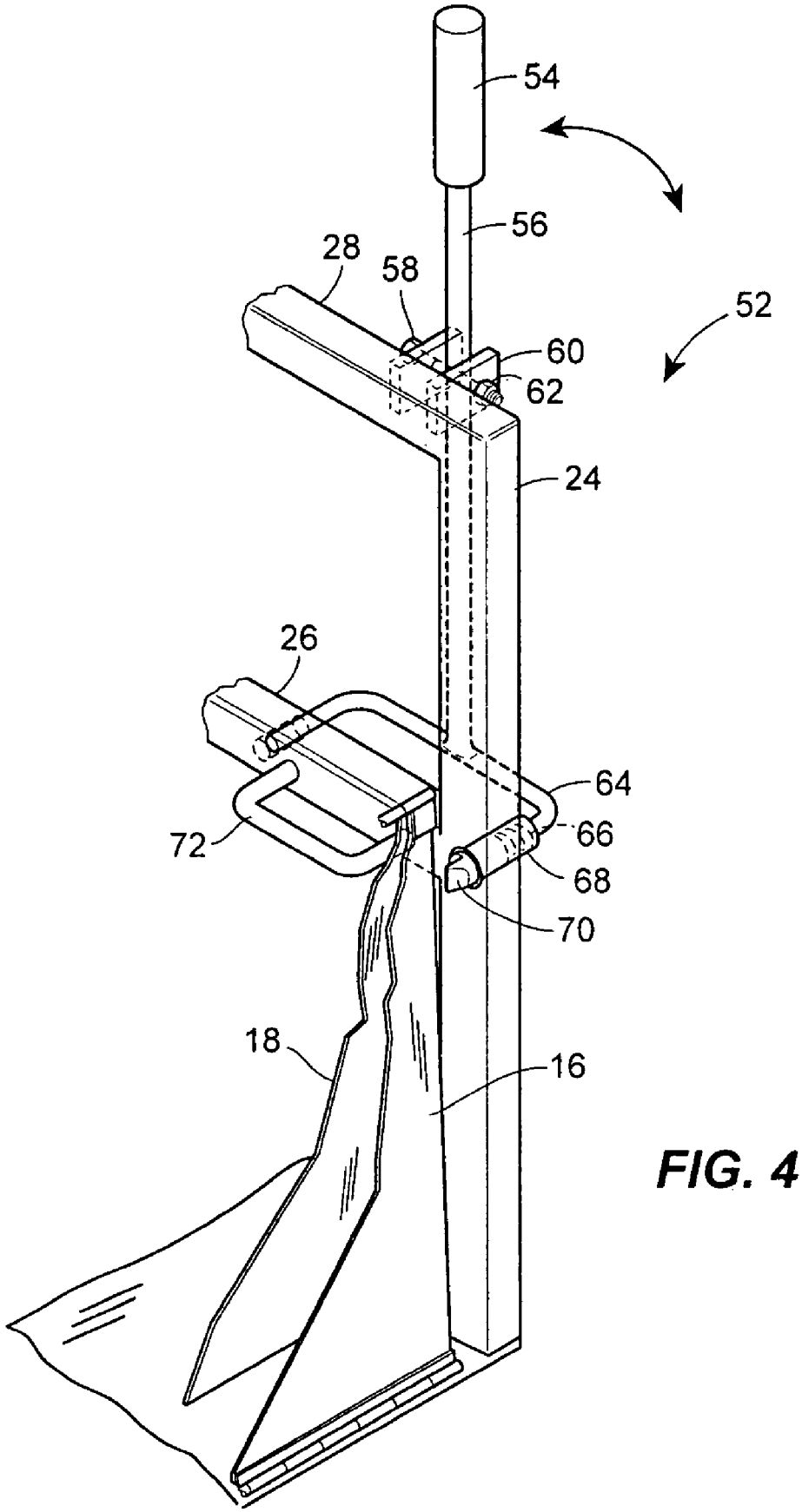
FIG. 4 is a detail view of a corner of the assembly.

The assembly 11 of the illustrated warehouse loader 10 has a spring-loaded latch that is arranged to secure the platform sections 16, 18 while they are not in use. FIG. 4 shows a detailed view of this latch. A handle 54 is connected to the top of a lever 56 that pivots around a hinge bolt 58 during use. This hinge bolt 58 feeds through apertures in the lever 56 and in a hinge bracket 60, and is secured with a hinge nut 62. The bottom of the lever 56 connects to a u-shaped bracket 64, which is oriented perpendicularly to the plane of the lever 56. The bracket 64 includes a platform latch end 70 that extends through an aperture in an upright 24. The leading edge of the upright 24 includes a spring housing 68 that contains a spring 66 that is attached to the bracket 64, biasing the latch end into the aperture in the upright. In that position, the latch end 70 projects into the unfolding path of the platform sections 16, 18, thus obstructing the unfolding of those sections. Thus, this latch can selectively hold the first platform section 16 in an upright position, with the second platform section 18 folded against one side of the first platform section.

As shown in FIG. 4, as the handle 54 is pulled by the operator inwardly, the lever 56 will rotate around the hinge bolt 58, and the latch end 70 will be pulled backward through the upright 24 (against the force of the spring 66), thus releasing the platform sections 16, 18 and allowing them to be unfolded and placed into an extended, horizontal position.

When platform sections 16, 18 are being rotated back into their upright folded positions, as they each pass the angled face of the latch end 70, they will depress the spring 66 of the latch end, and the latch end will be forced backward through the upright 24, thus allowing the platform sections 16, 18 to pass. A stop 72 can be included on the second end of the bracket 64 to limit the travel of the second platform section 18, which is the first platform section to pass by the latch end 70.

Figure 5:
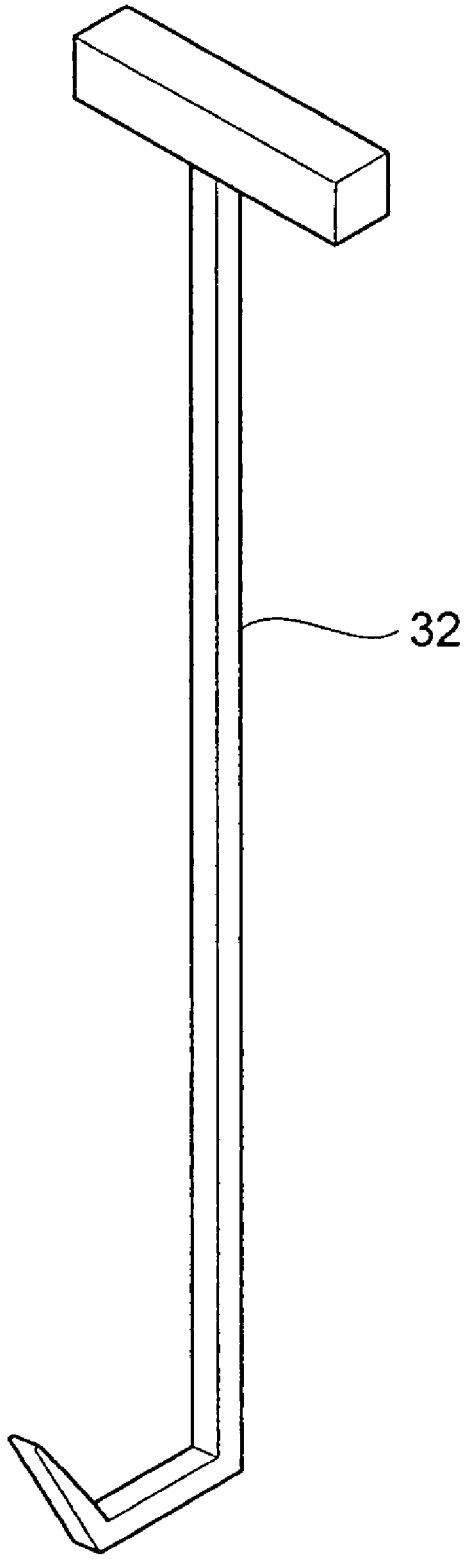
FIGS. 5 and 6 are perspective and side views of a positioning hook that can be used with the assembly.
Figure 6:
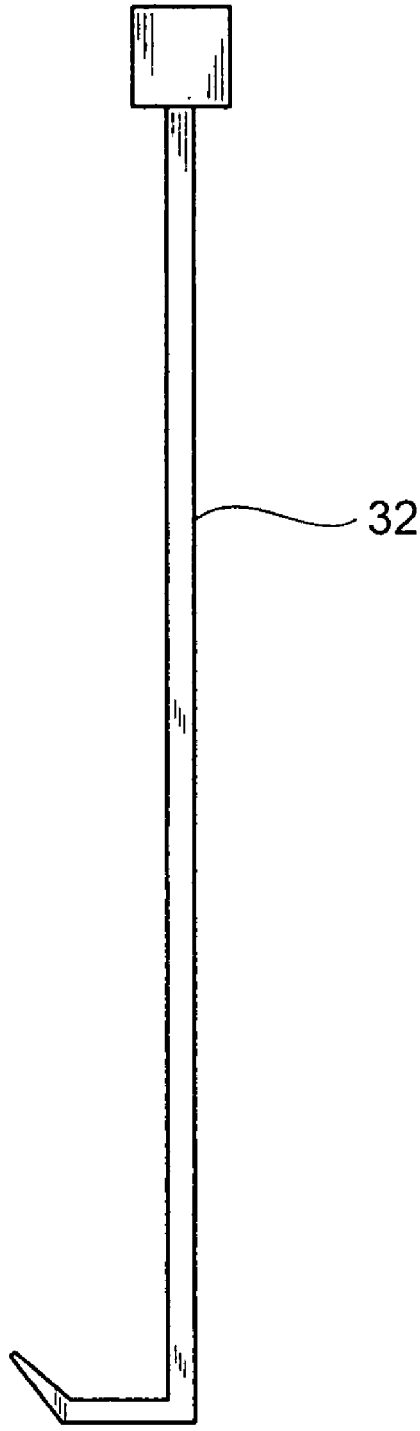

FIG. 5 shows a perspective view of one example of a positioning hook 32 and FIG. 6 shows a side view of that hook.

Figure 7:
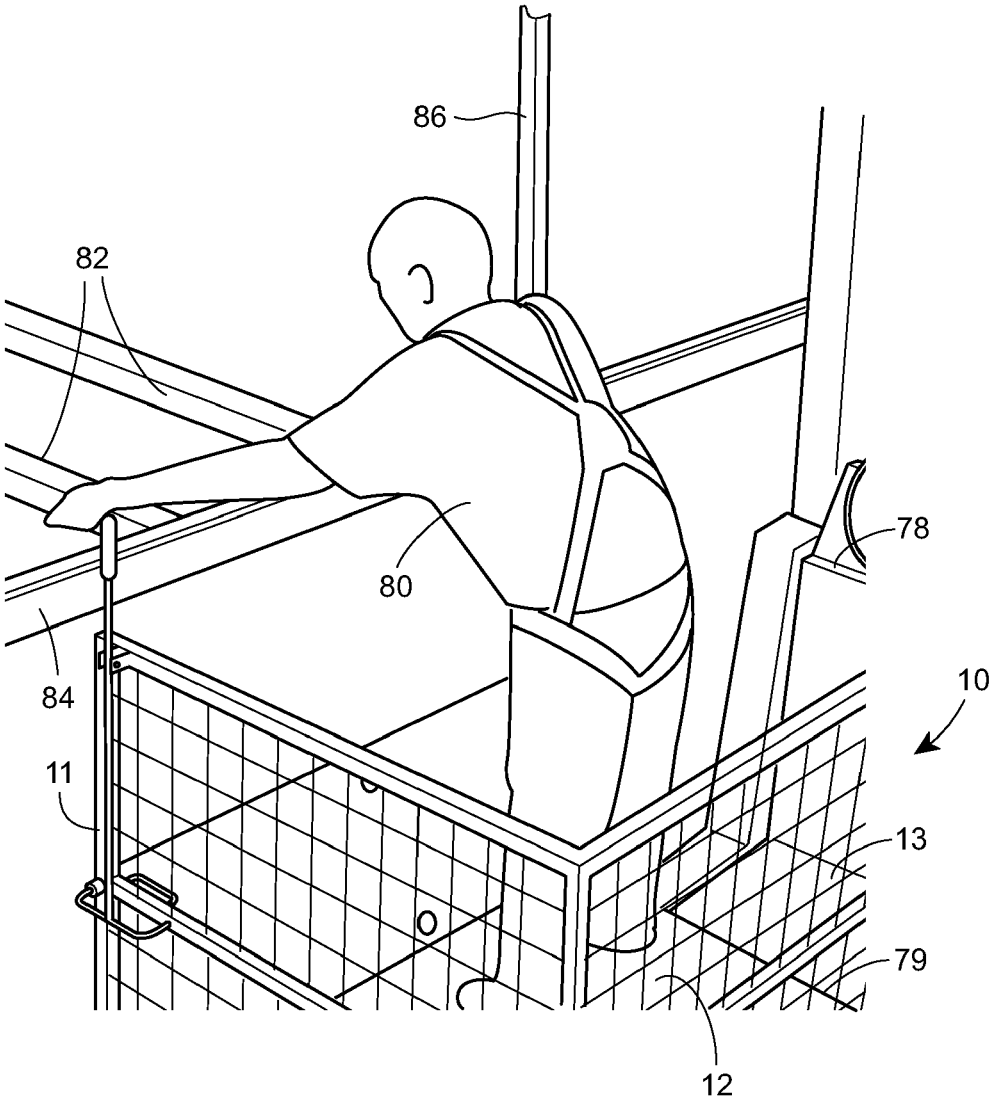
FIG. 7 is a perspective view of the loader in use.

FIGS. 1 and 7 show the assembly 11 positioned on the order selector 78. Mounting the assembly 11 on an order selector allows the operator to conveniently enter the operating deck 12 from the driving deck 13 by stepping across a boundary 79 that separates the operating deck from the driving deck, without stepping off the loader, and will often be safest and preferred.

To retrieve a spilled article, the operator 80 first establishes an open location adjacent the spilled article. A pallet may need to be moved to establish an open location. The warehouse loader 10 is then moved adjacent the open location. Once the warehouse loader 10 is in a useful location, the order selector 78 can be used to raise the assembly 11 to the proper level to facilitate the transfer of shelf contents, whether for loading or unloading.

FIG. 7 shows the operator 80 standing upon the operating deck 12 of the assembly 11 of the warehouse loader 10, checking the structural rigidity of a pallet support 82 onto which the platform sections 16, 18 of the warehouse loader 10 can be unfolded. The vertical positioning of the warehouse loader 10 is important for its safe usage.

Figure 8:
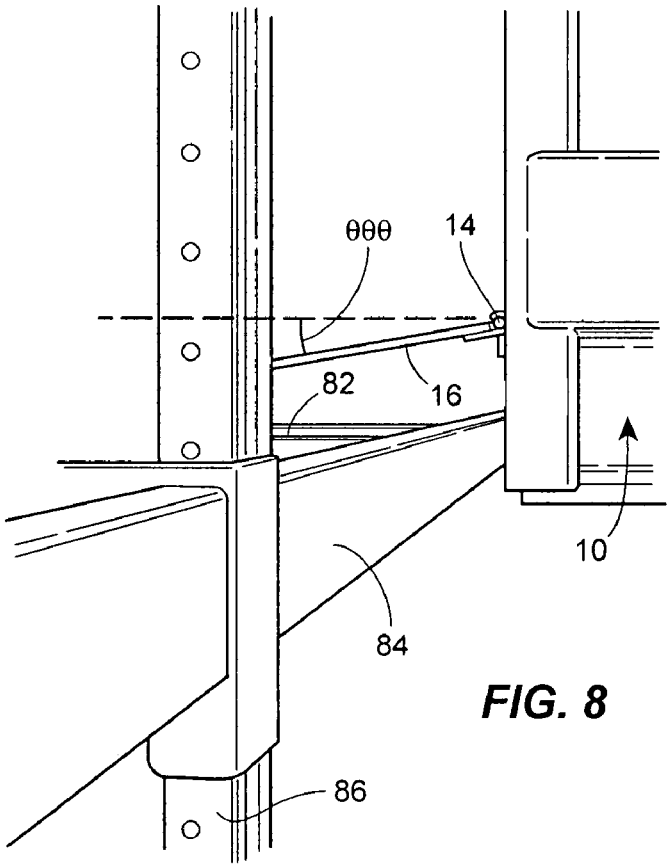
FIGS. 8 and 9 are detail views of the platform being extended into a warehouse location.
Figure 9:
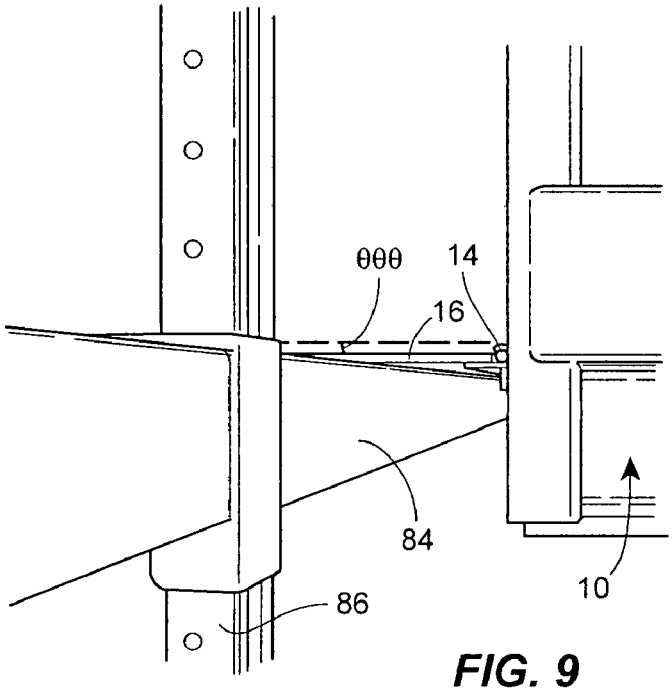

FIG. 8 shows the warehouse loader 10 with its platform section 16 extended and resting on a pallet support 82. As shown, a shelf rack 86 may support each shelf 84. An angle "ΘΘΘ" is created between the plane of the platform section 16 and the horizontal. In general, the closer this angle "ΘΘΘ" is to zero degrees, the safer the vertical positioning is of the warehouse loader 10. FIG. 9 shows this angle "ΘΘΘ" at zero degrees and thus the platform sections 16, 18 are horizontal. The platform section 16 rests horizontally on the top surface of a shelf 84 as well as on top of each pallet support 82, thus posing fewer safety risks for the operator 80. The angle "ΘΘΘ" at zero degrees also results in less strain being placed upon the hinge 14 that is used to affix the first platform section 16 to the operating deck 12, as to do otherwise could lead to premature failure of this hinge.

Figure 10:
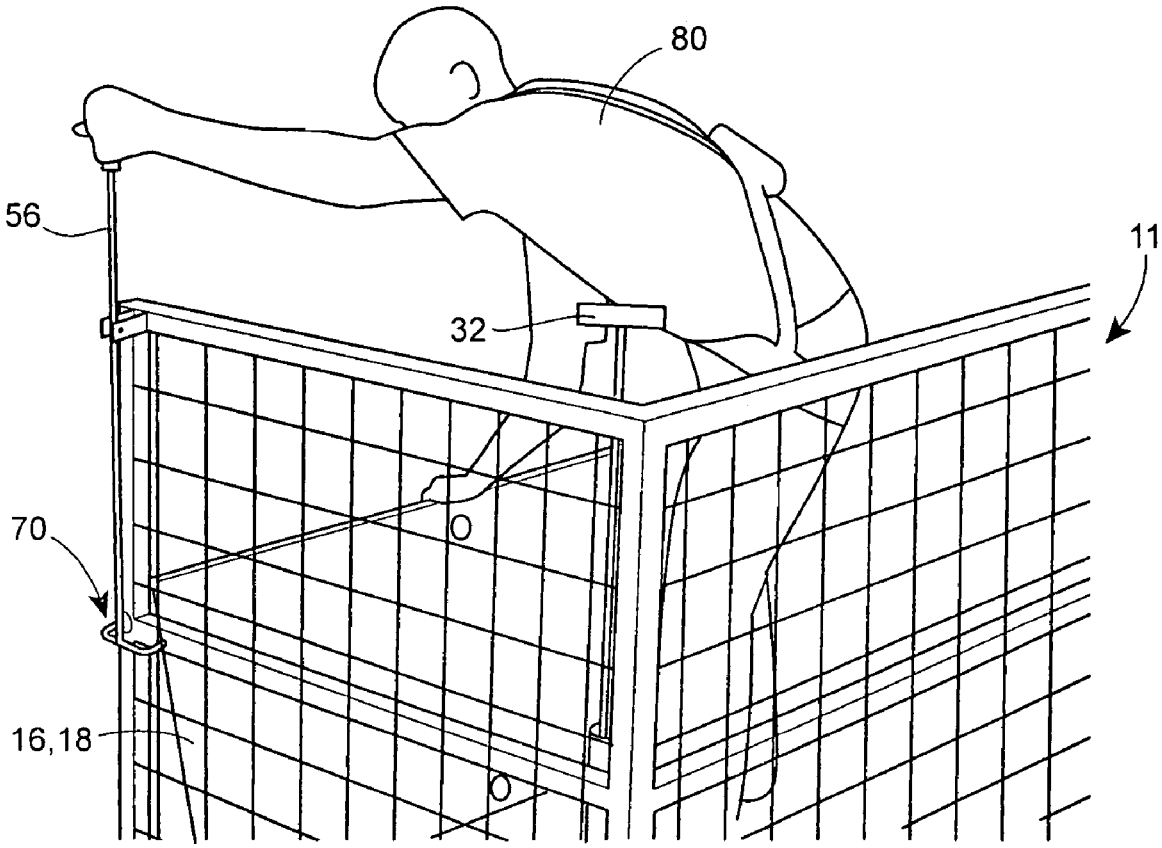
FIGS. 10-13 are perspective views of an operator extending the platform sections.

FIG. 10 shows the operator 80 pulling the lever 56 inward, thus releasing the latch end 70, allowing the movement of the platform sections 16, 18 from their folded upright resting position. The operator's right hand is holding the platform sections 16, 18 until the positioning hook 32 is obtained.

Figure 11:
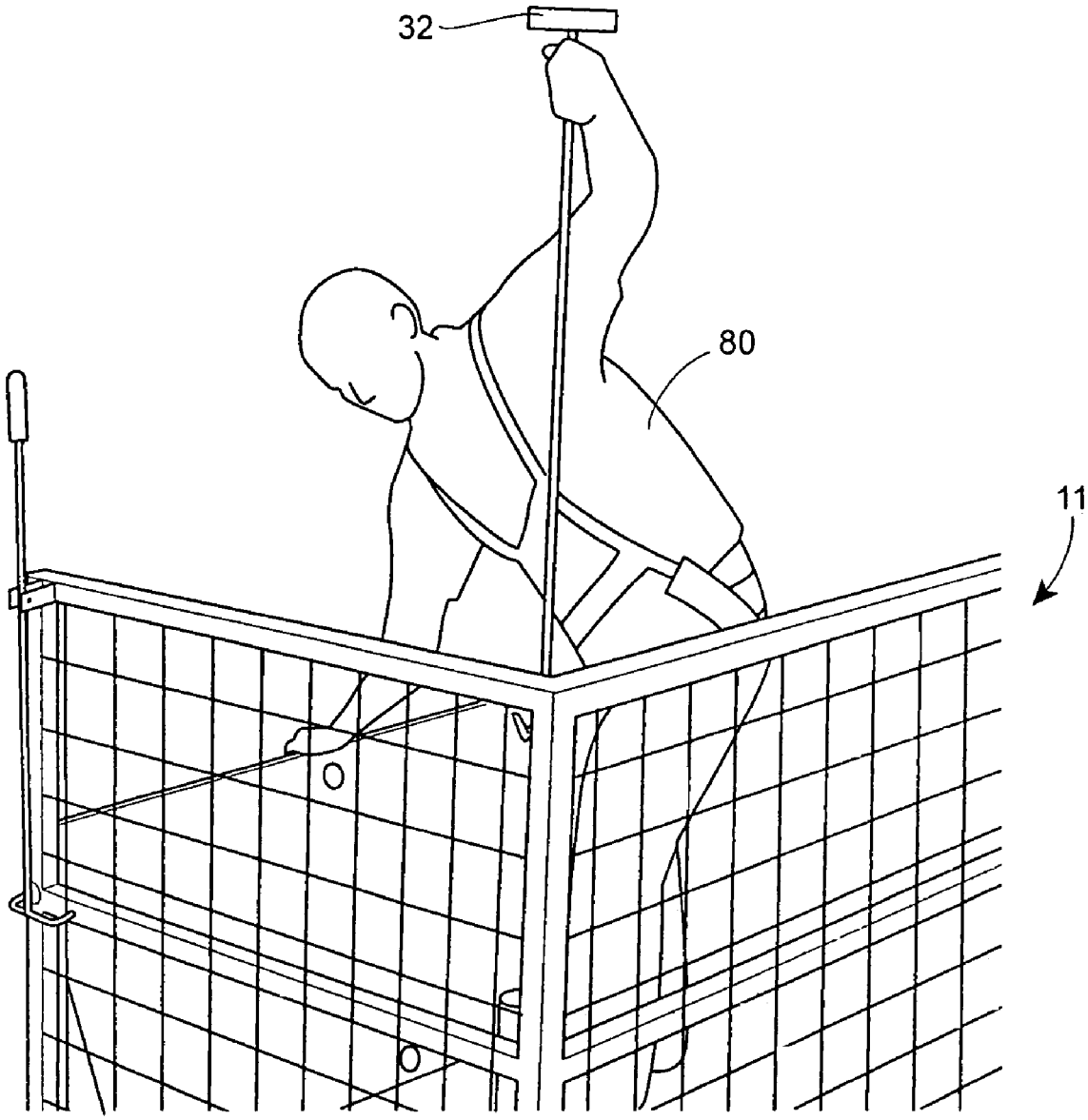

FIG. 11 shows the operator's left hand obtaining the positioning hook 32.

Figure 12:
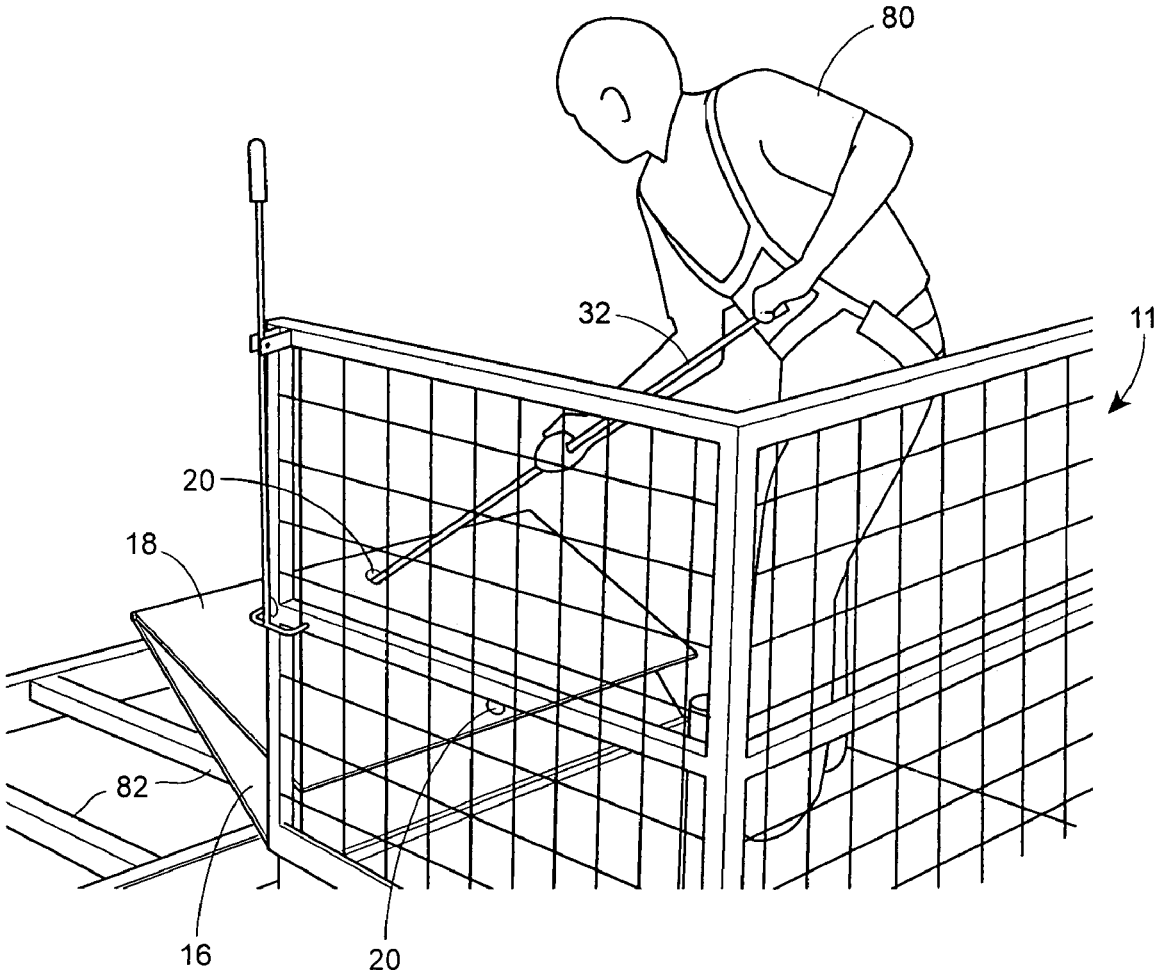
Figure 13:
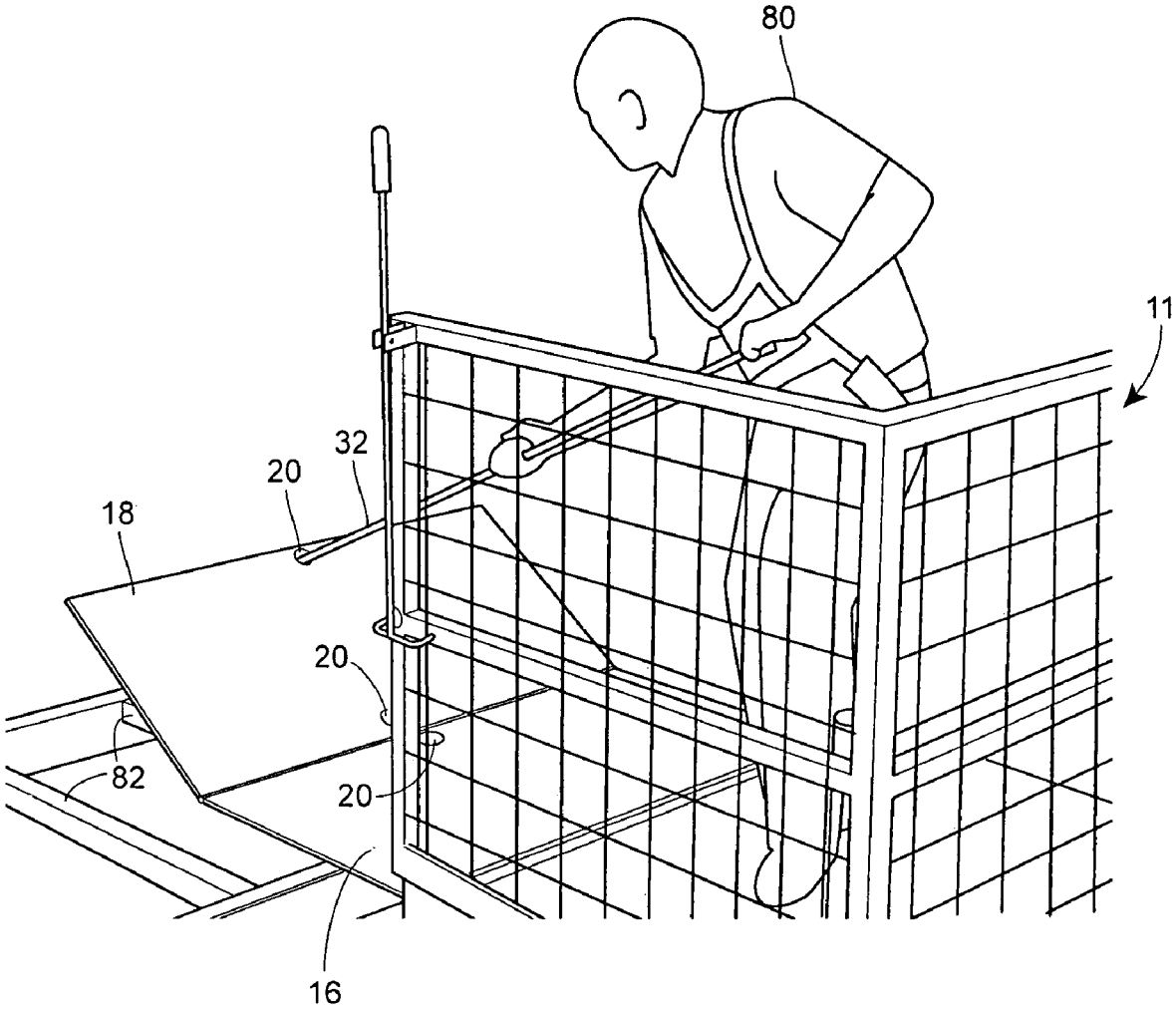

FIG. 12 shows the positioning hook 32 having been inserted in the positioning aperture 20 of the platform section 18, with the operator 80 allowing gravity to slowly pull the platform section 16 downward toward a flat, unfolded position. After the platform section 16 reaches its final unfolded position, the operator 80 removes the positioning hook 32 from its current positioning aperture 20 and places it into the positioning aperture 20 on the opposite side of the same platform section 18. The operator then proceeds to unfold the platform section 18, as seen in FIG. 13, until it rests horizontally on the pallet supports 82.

Figure 14:
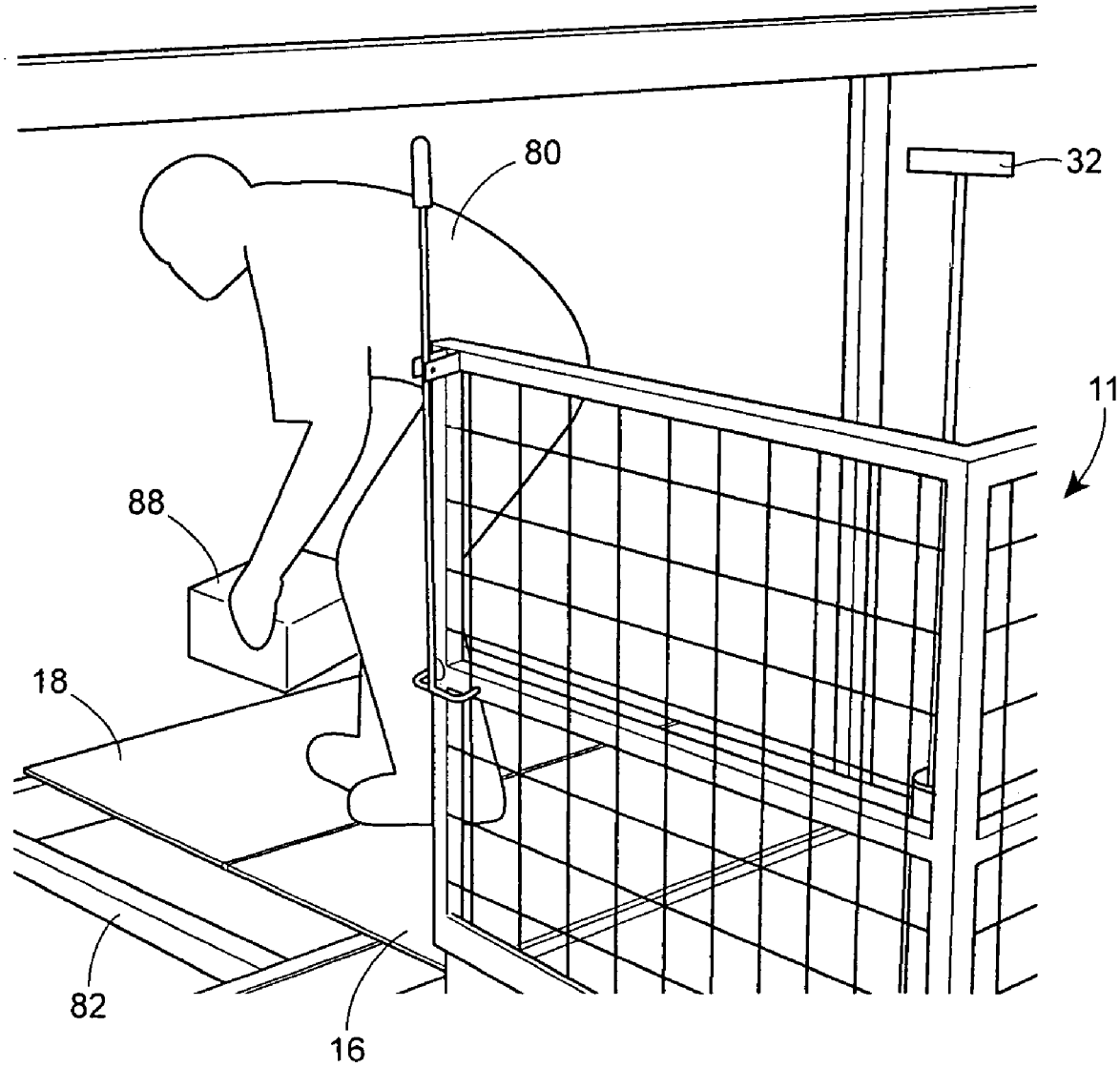
FIG. 14 is a perspective view of an operator using the platform sections to retrieve a spilled article.
Figure 15:
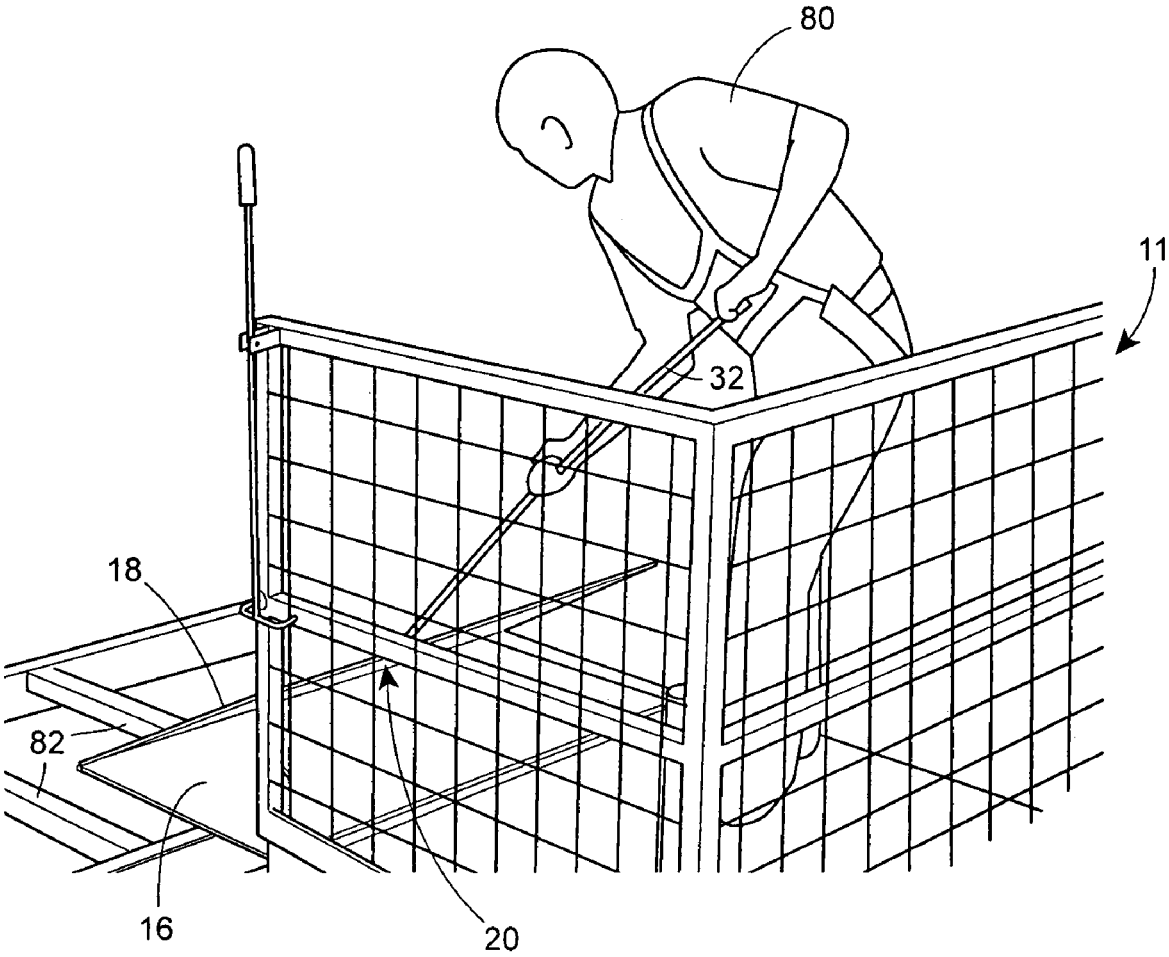
FIGS. 15 and 16 are perspective views of an operator re-folding the platform sections.
Figure 16:
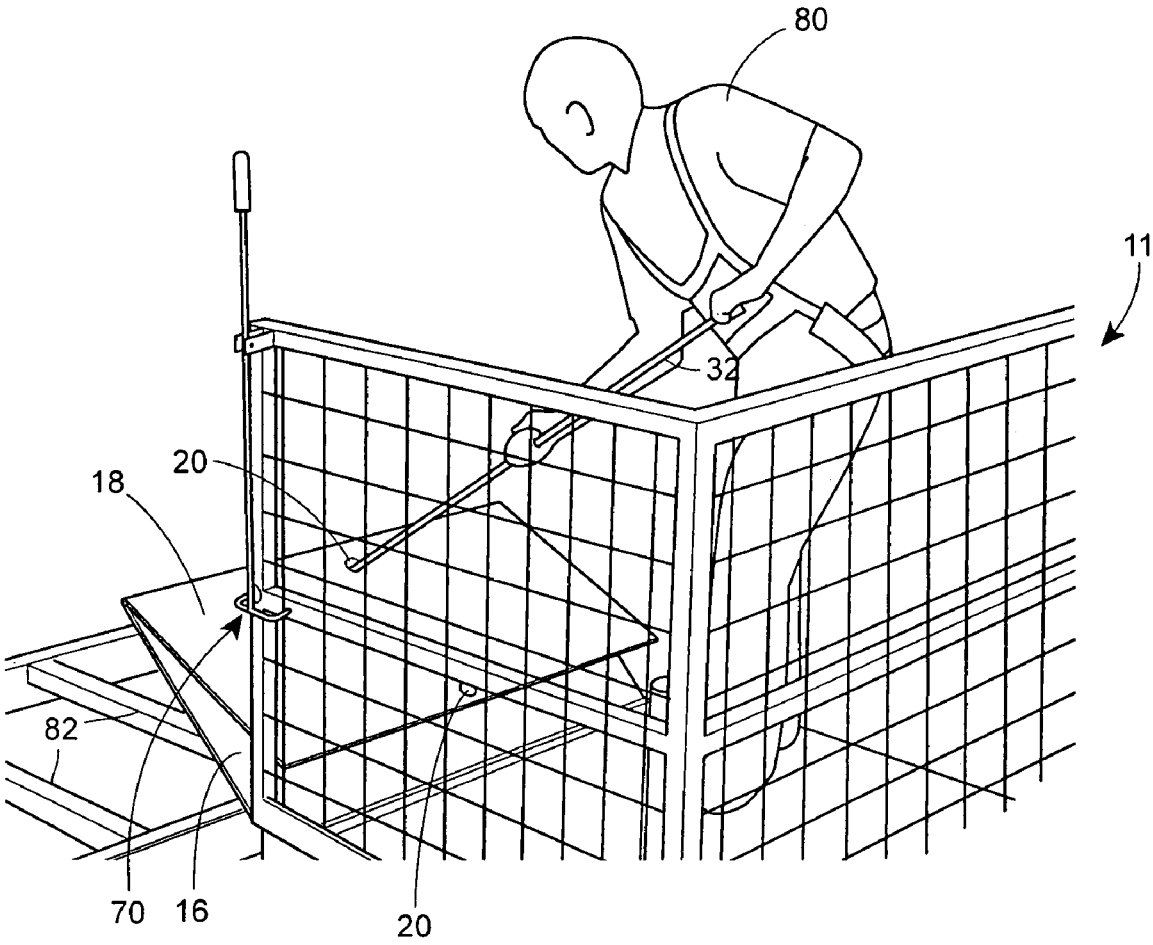
Figure 17:
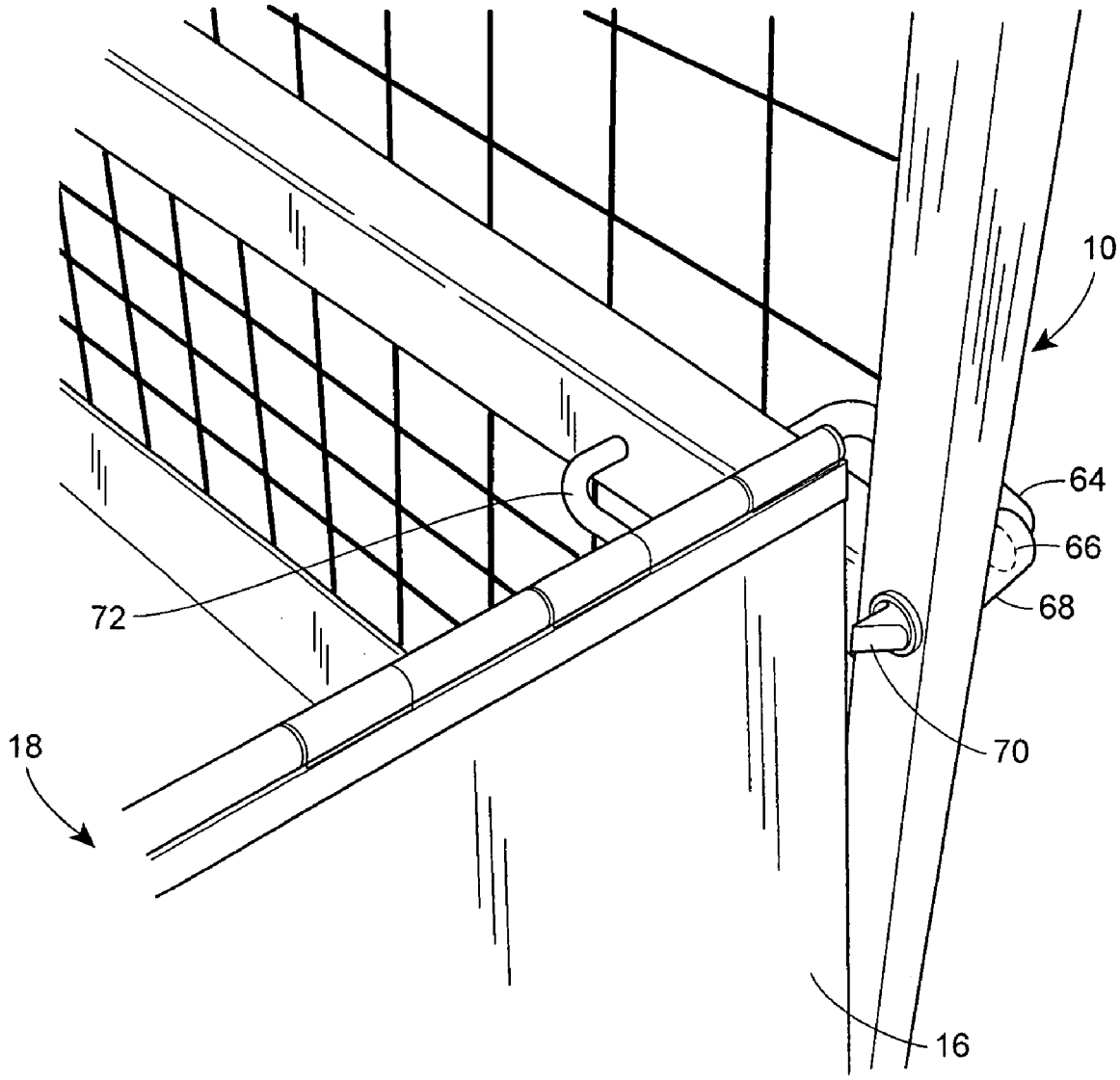
FIG. 17 is a perspective view of a mechanism that can be used to lock the platform sections in a folded position.

FIG. 14 shows the platform sections 16, 18 in their fully-extended horizontal position, with the operator 80 standing upon them, retrieving a spilled article 88. Upon completion of the task, the operator 80 again places the positioning hook 32 into a positioning aperture 20 located on the platform section 18, and, as seen in FIG. 15, proceeds to fold the platform section 18 until it reaches its maximum folded position (as far as hinge permits). The operator 80 then removes the positioning hook 32 from its current positioning aperture 20 and places it into the other positioning aperture 20 on the opposite side of the same platform section 18, and, as shown in FIG. 16, proceeds to fold the platform sections 16, 18 toward their final upright resting position. The platform sections 16, 18 will then both brush past the angled face of the latch end 70 until the platform section 18 abuts the stop 72 (see FIG. 17), and can travel no further. After the platform sections pass by the angled face of the latch end 70, the spring 66 will force the latch end 70 back to its resting position, and the platform sections 16, 18 will be restrained from traveling in an outward direction away from the warehouse loader 10. FIG. 17 shows the final upright resting position of platform sections 16, 18.

The illustrated latch mechanism keeps the platform sections 16, 18 from falling inward toward the operator 80 and outward away from the operator. Alternatively, the warehouse loader 10 may have other structural arrangements to restrain platform section 16, 18 in an upright resting position. These arrangements may include such restraining devices as latches, clamps, sliding bolts, hooks, etc.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A method of retrieving a spilled article, the method comprising the steps of:

(i) providing a vehicle that has forks and a driving deck from which an operator drives the vehicle from one location in a warehouse to another location in the warehouse;

(ii) providing a removable platform that has:

(a) a separate operating deck that has a service side, two closed sides, and an egress side, each of the four sides being perpendicular to its neighboring sides;

(b) a first extendable platform section that is hinged to the service side of the operating deck and has a distal end; and (c) a second extendable platform section that is hinged to the distal end of the first platform section and can be aligned with the first platform section to create an extended platform that extends outwardly from the service side of the operating deck;

(iii) making a loader by removably positioning the platform on the forks of the order selector so that the egress side faces the order selector;

(iv) driving the loader from its original location to a new location in the warehouse;

(v) having the operator step over the egress side of the operating deck directly from the driving deck onto the operating deck without stepping onto the floor of the warehouse;

(vi) raising the operating deck;

(vii) extending the extended platform from the service side into a location near the spilled article; and (viii) having the operator move over the service side of the operating deck onto the extended platform and retrieving the spilled article while standing on the extended platform.

2. A method as recited in claim 1, in which the egress side and the service side are perpendicular to each other.

3. A method of retrieving a spilled article in a warehouse, the method comprising the steps of:

providing a removable assembly that has an operating deck, a first extendable platform section that is hinged to the operating deck and has a distal end, and a second extendable platform section that is hinged to the distal end of the first extendable platform section and can be aligned with the first extendable platform section to create the foldable platform that extends outwardly from the operating deck and is accessible by the operator directly from the operating deck;

making a loader by positioning the removable assembly onto the forks of a vehicle so that the operating deck is adjacent to a driving deck on the vehicle and an operator can directly enter the operating deck from the driving deck; and having an operator perform the steps of:

establishing an open location adjacent the spilled article;

driving the loader from one location in a warehouse to a location adjacent the open location while operating the loader from the driving deck;

stepping directly from the driving deck to the operating deck without stepping onto the floor of the warehouse;

raising the operating deck;

extending the foldable platform into the open location;

moving from the operating deck onto the foldable platform and from there retrieving the spilled article; and positioning a hook in a receptacle near the distal edge of one of the extendable platform sections when moving the extendable platform sections while standing on the operating deck.

4. A method as recited in claim 3, in which the operator positions the hook in receptacles near the proximal and distal edges of the second extendable platform section when moving the extendable platform sections.

5. A method as recited in claim 4, in which the first extendable platform section has a receptacle that aligns with one of the receptacles on the second extendable platform section when the extendable platform sections are folded together, and that the operator also uses when moving the platform sections while standing on the operating deck.

* * * * *